US009121156B1

(12) United States Patent
Calvert

(10) Patent No.: US 9,121,156 B1
(45) Date of Patent: Sep. 1, 2015

(54) SOIL STABILIZER

(71) Applicant: SS Associates, Trustee for Soil stabilizer CRT Trust, Manassas, VA (US)

(72) Inventor: S. Mill Calvert, Manassas, VA (US)

(73) Assignee: SS Associates, Trustee for Soil stabilizer CRT Trust, Manassas, VA (US)

( * ) Notice: Subject to any disclaimer, the term of this patent is extended or adjusted under 35 U.S.C. 154(b) by 0 days.

(21) Appl. No.: 14/727,605

(22) Filed: Jun. 1, 2015

(51) Int. Cl.

| | |
|---|---|
| ***E02D 7/26*** | (2006.01) |
| ***E02D 3/12*** | (2006.01) |
| ***E02D 5/46*** | (2006.01) |
| ***E02D 27/34*** | (2006.01) |
| ***E21B 7/26*** | (2006.01) |

(52) U.S. Cl.
CPC .. *E02D 3/12* (2013.01); *E02D 5/46* (2013.01); *E02D 27/34* (2013.01); *E21B 7/26* (2013.01); *E02D 2250/003* (2013.01)

(58) Field of Classification Search
CPC ..... E21B 7/26; E21B 4/145; E21B 7/205; E21B 7/30; E02D 3/12; E02D 27/34; E02D 2250/003; E02D 5/46
See application file for complete search history.

(56) References Cited

U.S. PATENT DOCUMENTS

| | | | | |
|---|---|---|---|---|
| 1,987,626 | A | 1/1935 | Klie | |
| 3,375,885 | A * | 4/1968 | Scott et al. | 175/26 |
| 3,550,698 | A * | 12/1970 | Pauley | 175/57 |
| 3,971,222 | A | 7/1976 | Griffith, Jr. | |
| 4,084,381 | A | 4/1978 | Cain et al. | |
| 4,309,129 | A | 1/1982 | Takahashi | |
| 4,623,025 | A * | 11/1986 | Verstraeten | 175/21 |
| 4,726,711 | A * | 2/1988 | Tian | 405/184 |
| 4,911,584 | A | 3/1990 | Arenzana | |
| 5,868,525 | A | 2/1999 | Takahashi | |
| 6,634,831 | B2 | 10/2003 | Canteri | |
| 7,055,625 | B1 * | 6/2006 | Myrick et al. | 175/26 |
| 7,517,177 | B2 | 4/2009 | Erdemgil | |
| 7,789,591 | B2 | 9/2010 | Hakkinen et al. | |
| 8,956,083 | B2 | 2/2015 | Hakkinen et al. | |
| 2005/0158128 | A1 | 7/2005 | Canteri | |
| 2009/0188137 | A1 * | 7/2009 | Yasuda | 37/350 |
| 2009/0301779 | A1 * | 12/2009 | Bick | 175/45 |

* cited by examiner

*Primary Examiner* — John Kreck
*Assistant Examiner* — Carib Oquendo
(74) *Attorney, Agent, or Firm* — Louis Ventre, Jr.

(57) ABSTRACT

A device is capable of autonomously burrowing into the earth and, when at depth, discharging a fluid into a geologic formation. The device includes a component body holding a computer controller; a battery; a motor; and a coiled hose. A drill head external to the component body is equipped with a spiral blade that burrows down pulling the component body with it. A cylindrical shell surrounding the component body creates an annulus where debris from the drill head flows upward. The coiled hose is released from the component body as the device descends. An electrical cable may be co-wound with the coiled hose or may be embedded in the wall of the coiled hose. Fluid may be conveyed through the coiled hose to a discharge valve in the component body. The discharge valve is connected to a telescoping discharge nozzle.

3 Claims, 3 Drawing Sheets

SOIL STABILIZER

TECHNICAL FIELD

In the field of devices for penetrating the earth or geologic formation, a device injects a fluid into the geologic formation to harden the formation or for other purposes. The fluid is provided from an above ground source and the penetration of the earth occurs by displacing material to form a borehole without extraction of all of the material from the borehole.

BACKGROUND ART

Applicant invented geo-diving technology as documented in U.S. patent application Ser. No. 14/686,518 filed 14 Apr. 2015, which is hereby incorporated by reference herein in its entirety. The geo-diving technology may be used for penetrating the earth or geologic formation without extraction of all of the material from a borehole. It involves an apparatus that includes means peculiar to displacing material to form a borehole while refilling the borehole above the apparatus while the apparatus is in the earth or geologic formation. The present invention is an adaptation of the geo-diving technology that enables injection of a liquid or other fluid into the geologic formation to harden the geologic formation against subsidence, to enhance foundational support of surface structures, or to accomplish other purposes.

The earth is the structural foundation support for both human lives and all of humanity's various roads, bridges, houses, buildings and structures. It is well known that mankind greatly relies on the strength and support that the earth provides and that humanity always expects this strength and support to be there for our use.

Unfortunately, many times the strength and support of the surface of the earth is an ongoing process of geologic change, and what may have been at one time a solid surface in order to build a heavy building or structure, may at a later date be an area of soil instability which can lead to severe property damage or even the collapse of structures that have been build there.

There can be many different geologic layers that cause soil instability. Some of these, for example, are earthquakes, settling of soil that was backfilled, changes in underground water pathways, decay and changes in soil layers, and the seemingly ever more common sinkholes seen on the news.

Civil engineers introduce a variety of materials in a geological formation to stabilize soils, or improve subgrades in the subsurface layers adjacent the surface of the earth. Subsurface stability requirements are common when seeking to improve subgrades for example for airport runways, railroad tracks, streets, and, improving the slopes to prevent their sliding collapse.

Architectural engineers and structure builders using modern construction practices are sometimes involved in pretreating bridge and building sites in order to improve the foundational support strength and water flow characteristics of soils. For example, lime slurries have been worked into the top layers of soil to as deep as two feet to stabilize the base soils. Others have injected furfural alcohols in subterranean formations for the same purpose.

In other applications, chemical grout has been injected into soils. Injection typically requires drilling out a hole in the ground. Once the hole is clear, the chemical grout, which is like cement, is injected into the hole under high pressure. Like cement, the chemical grout reacts with water to cure into a solidified mass. The chemical ground is sometimes a grout that expands during solidification. In addition, a catalyst is sometimes used to speed the reaction time.

Available liquid soil stabilizers are sometimes classified into one of three types: (1) ionic stabilizers, which are thought to work through cation exchange within a clay mineral; (2) polymer stabilizers, composed of various polymers; and (3) enzyme stabilizers, reported to consist of organic catalysts.

As an example of soil stabilization, liquid resin bonding fluids are available to treat soil. These are polymer materials that coalesce to create bonds between the soil or aggregate particles. They are in essence liquid glues that form a solid mass with the soil upon hardening. The resulting long molecular structures cross-link together to create a solid-mass that is durable and water resistant. A second example of available fluid soil stabilization is a liquid ionic stabilizer, widely believed to stabilize anionic soils and improve the load bearing of clayey soils.

SUMMARY OF INVENTION

A device is capable of autonomously burrowing into the earth and, when at depth, discharging a fluid into a geologic formation. The device includes a component body holding a computer controller; a battery; a motor; and a coiled hose. A drill head external to the component body is equipped with a spiral blade that burrows down pulling the component body with it. A cylindrical shell surrounding the component body creates an annulus where debris from the drill head flows upward. The coiled hose is released from the component body as the device descends. An electrical cable may be co-wound with the coiled hose or may be embedded in the wall of the coiled hose. If included, this electrical cable is preferably adapted to provide electrical power to the battery and the motor. Also, this electrical cable is preferably further adapted to provide a wired connection for sending instructions from the surface to the computer controller. For this embodiment, a user input and power supply would provide the electrical power and wired connection for user input to the computer controller. Fluid may be conveyed through the coiled hose to a discharge valve in the component body. The discharge valve is connected to a telescoping discharge nozzle.

Technical Problem

What is missing in traditional soil stabilization methods are: a cost effective means to deliver injection fluids to a relatively deep geological location without compromising structural support and soil stability by drilling holes; and an easy process for injecting stabilization fluids at depth without having to remove the soil from a hole created to reach the geological location.

Situations may exist where the soil is no longer stable enough to hold together or support the weight of a building or structure that may be built on top of it.

Many millions of dollars in property loss and damage happen every year because of these various soil instability situations. There needs to be a way to provide soil stability to the unstable soil that lies underneath of an already built structure or facility. There needs to be a technological solution for property owners having unstable soil to preserve their surface facilities and roadways, saving a great deal of money, saving lives and avoiding personal tragedies.

Solution to Problem

The answer to soil instability problems has now been solved with the invention of the soil stabilizer. The soil stabilizer can be used to easily cause the unstable soil below an object to be solidified. The soil is held together to become stable so that it will support the weight that is placed on it from above.

The soil stabilizer is a device that enables various types of chemical solutions, that have been known to solidify soils, to be directly taken to the area of soil instability and to then saturate the unstable soil with the solution which will then cause the soil to congeal and solidify and once again become stable soil that can support the gravitational weight placed on it.

The soil stabilizer works by having an auger-type drill bit head that can also be a hammer drill. There is an electric motor that spans the head which causes the auger head to tunnel downward into the ground to the desired location.

The soil stabilizer also has a computer controller to manage all of its functions. As the auger head tunnels down into the ground, it simultaneously releases behind it a hose that is preferably of a lightweight, flexible plastic. The hose may include a slippery outer coating such as a TEFLON coating to ease movements within the earth. The hose may also be joined with one or more electrical wires in a cable that is either molded inside of the walls of the hose or adjoined to the hose, which serve to convey power and communication signals to and from the surface.

When the computer controller senses that the unit has reached the desired location, the drill auger bit head will stop. The hose runs from the surface and through the ground right to the desired spot where the unstable soil may be found. On the surface, a high pressure pump unit may now be attached to the hose to pump down various desired solutions to the spot where an injection arm resides. The solution is pumped through the hose until all the desired soil and geologic material becomes saturated with the solution. For instance, if one of the known solidifying solutions was pumped into the pocket of unstable soil, when the solution dried out, all of the loose unstable soil would now become a solid mass with the strength of rock and provide support for any heavy object that overlays the ground at the surface.

Advantageous Effects of Invention

No longer will a family have to watch as their personal house and everything they own in the world drops down to the bottom of a sinkhole. No longer will a bridge full of automobiles collapse because of soil instability. No longer will a train derail and crash because there was soil instability that caused a post of the railroad track to sink down. There are countless different examples of what a benefit it would be to stabilize the soil under existing building, structures, and roadways.

The soil stabilizer is a new technology that holds the potential to prevent property destruction and tragedy from surface subsidence and will once again give surface users the peace of mind of knowing that the earth will be the foundation to support both structures and lives.

BRIEF DESCRIPTION OF DRAWINGS

The drawings illustrate preferred embodiments of the soil stabilizer according to the disclosure. The reference numbers in the drawings are used consistently throughout. New reference numbers in FIG. 2 are given the 200 series numbers.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
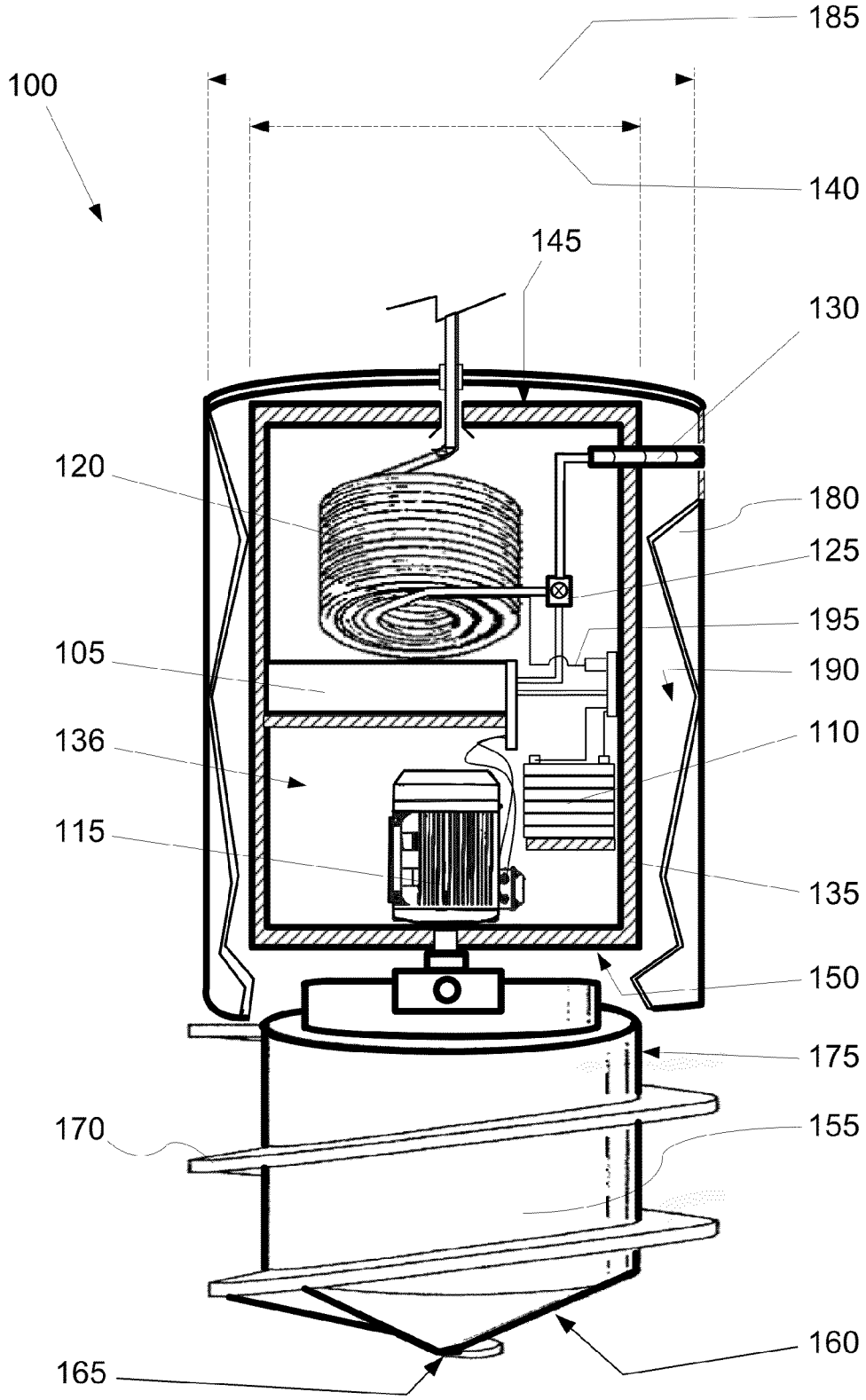
FIG. 1 is an elevation view of the soil stabilizer with a cutaway of the cylindrical shell showing the component body within.
Figure 2:
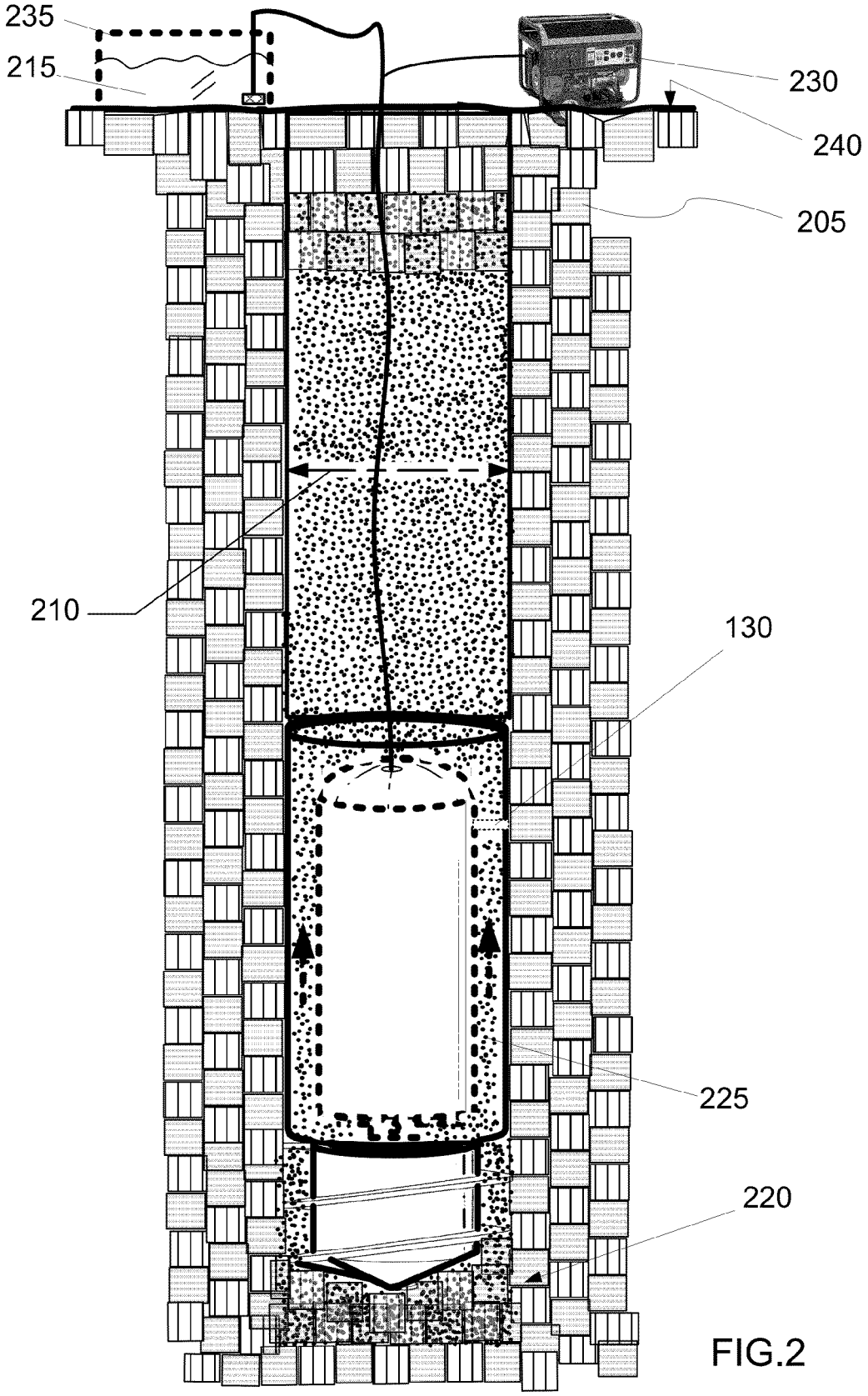
FIG. 2 is a side elevation view of the soil stabilizer within a geological formation and illustrating an embodiment having an unspooled hose and electrical cable up to an above-ground fluid supply, user input and power supply.

FIG. 1 is an elevation view of the device (100), which is also referred to as a soil stabilizer. The device (100) is used for penetrating the earth (205) while filling a hole (210) behind it and once at depth, the device (100) is then used for discharging a fluid (215) into the earth (205), that is, into a geologic formation (220). The term "earth" is used herein in the generic sense to mean a geologic formation within the Earth or within any planetary body, such as the moon or another planet.

The device (100) includes a computer controller (105); a battery (110); a motor (115); a coiled hose (120); a component body (135); a drill head (155); and a cylindrical shell (180). An electrical cable (195) may be co-wound with the coiled hose (120) or may be embedded in the wall of the coiled hose (120). If included, this electrical cable (195) is preferably adapted to provide electrical power to the battery (110) and the motor (115). Also, this electrical cable (195) is preferably further adapted to provide a wired connection for sending instructions from the surface (240) to the computer controller (105). For this embodiment, a user input and power supply (230) would provide the electrical power and wired connection for user input to the computer controller (105).

The computer controller (105) is the means to automate and operate the motor (115) and the drill head (155). The computer controller (105) is preferably programmed to operate autonomously and may include connections to alter operation as desired by a user at the surface (240).

Optionally, the component body (135) may include hydraulic arms (305) that extend outward to engage the geological formation (220), as is further described in applicant's Rammed earth geo-explorer patent application, U.S. patent application Ser. No. 14/714,266, filed 16 May 2015, which is hereby incorporated by reference herein. The hydraulic arms enable stopping any reactionary rotation of the component body (135) and provide a means to push downward on the drill head, if required.

The battery (110) supplies power to the computer controller (105), the motor (115), the drill head (155) and any other components requiring power to operate.

The motor (115) is powered through the battery (110) and controlled by the computer controller (105). If an electrical cable (195) is used along with the coiled hose (120), then it is connected to the battery (110) to serve as an additional power source.

The coiled hose (120) is adapted to hold a fluid (215), which for most embodiments is intended to encompass ability to convey the fluid (215) from a fluid tank (235) on the surface (240) to an injection point within the geologic formation (220). Thus, for these embodiments, the fluid tank (235) holds the fluid (215) that is flowably connected to the coiled hose (120). The coiled hose (120) is preferably reinforced for high pressure and able to resist compressive forces from the geological formation (220) and expansive forces from high pressure injection. As examples, wire reinforced hoses and KEVLAR reinforced hoses are commercially available for such purposes.

Figure 3:
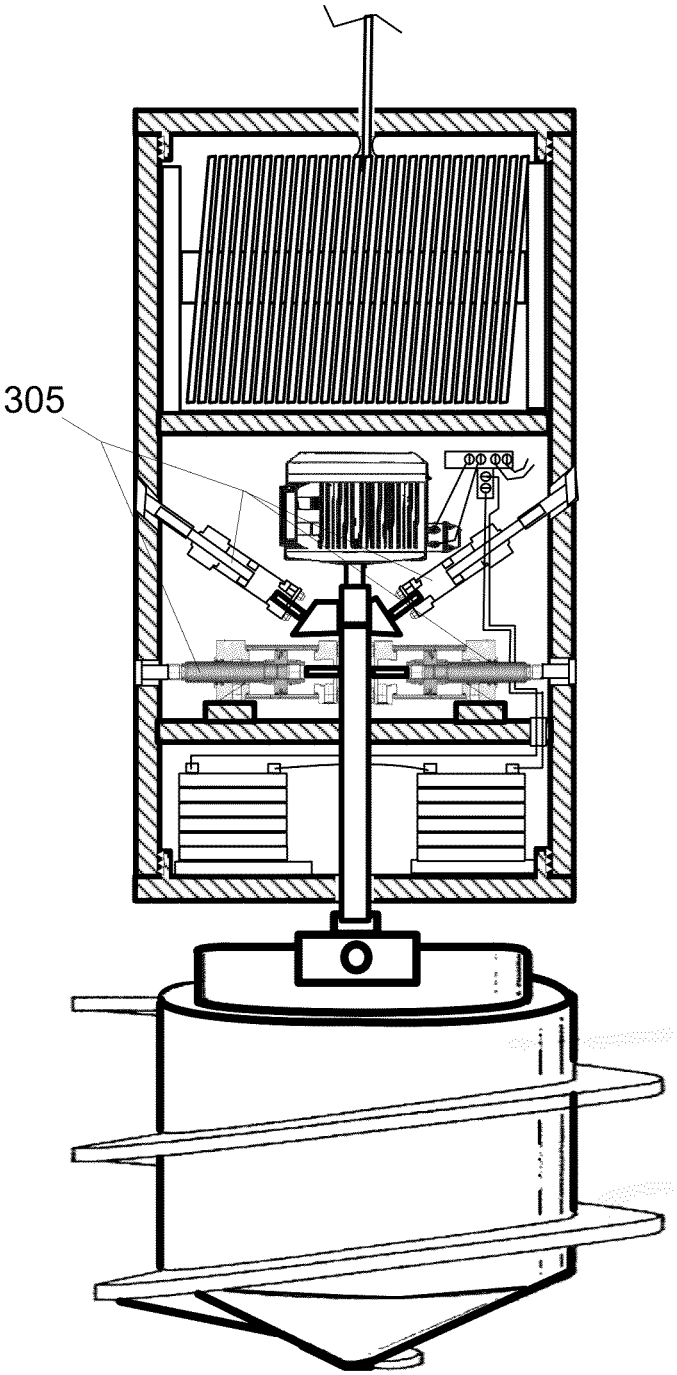
FIG. 3 is a sectional elevation view of an alternative component body and drill head of the soil stabilizer showing hydraulic arms.

The coiled hose (120) is connected to a discharge valve (125) controlled by the computer controller (105). The discharge valve (125) is connected to a telescoping discharge nozzle (130), which when extended into the geologic formation (220) becomes the injection point for the fluid (215). In an alternative embodiment, the coiled hose (120) may include a slippery outer coating such as a TEFLON coating to facilitate movements within the earth (205). Examples of the coiled hose (120) include a simple coil within the component body (135) as shown in FIG. 1, or a hose wound on a reel as shown in FIG. 3.

The component body (135) preferably has a hollow cylindrical in shape and has an outer diameter (140), a top end (145) and a bottom end (150). The component body (135) is the enclosure or container that holds those components of the device (100) that transit into the earth (205) with the drill head (155). Thus, the component body (135) defines an enclosed hollow internal structure (136) that is adapted to contain at least: the coiled hose (120); the computer controller (105); the battery (110); and the motor (115). The component body (135) is further adapted to permit the coiled hose (120) to be uncoiled out of the component body (135) through its top end (145) as the drill head descends into the geological formation (220).

The drill head (155) defines, at least partially, a conical shape (160) rising from a pointed end (165). The drill head (155) is rotatably mounted to the motor (115) through the bottom end (150) of the component body (135). The drill head (155) has a spiral blade (170) at least on an outer peripheral surface (175) of the conical shape (160), and preferably along the entire length of the drill head (155). The spiral blade (170) starts at the pointed end (165) and rises toward the component body (135). The drill head (155) may include an extendable cutting blade that enables the drill head (155) to act similarly to a hammer drill. Extension of the cutting blade is preferably controlled by the computer controller (105).

The cylindrical shell (180) is attached to the component body (135) and has an inner diameter (185) larger than the outer diameter (140) of the component body (135). Preferably, the cylindrical shell (180) extends from the bottom end (150) of the component body (135) to surround the component body (135). The cylindrical shell (180) forms an annulus (190) between an inner wall of the cylindrical shell (180) and an outer wall of the component body (135). The annulus (190) is configured to receive debris (225) from the spiral blade (170).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the drilling industry.

What is claimed is:

1. A device for penetrating the earth while filling a hole behind it, the device usable for a purpose of discharging a fluid in a geologic formation, the device comprising:

a computer controller;

a battery supplying power to the computer controller;

a motor powered through the battery and controlled by the computer controller;

a coiled hose adapted to hold the fluid, the coiled hose connected to a discharge valve controlled by the computer controller, the discharge valve connected to a telescoping discharge nozzle;

a component body having an outer diameter, a top end and a bottom end, the component body defining an enclosed hollow internal structure adapted to contain: the coiled hose; the computer controller; the battery; and the motor; the component body further adapted to permit the coiled hose to be uncoiled out of the component body through the top end;

a drill head comprising a conical shape rising from a pointed end, the drill head rotatably mounted to the motor through the bottom end of the component body, the drill head comprising a spiral blade on an outer peripheral surface of the conical shape, the spiral blade starting at the pointed end and rising toward the component body; and a cylindrical shell attached to the component body and having an inner diameter larger than the outer diameter of the component body, the cylindrical shell extending from the bottom end of the component body to surround the component body, the cylindrical shell forming an annulus between an inner wall of the cylindrical shell and an outer wall of the component body, the annulus configured to receive debris from the spiral blade.

2. The device of claim 1, further comprising an electrical cable co-wound with the coiled hose, the electrical cable adapted to provide electrical power to the battery and the motor, the electrical cable further adapted to provide a connection for sending instructions to the computer controller.

3. The device of claim 1, further comprising the fluid tank holding a fluid that is flowably connected to the coiled hose.

* * * * *